US006408550B1

(12) United States Patent
Allsopp et al.

(10) Patent No.: US 6,408,550 B1
(45) Date of Patent: Jun. 25, 2002

(54) MOUNTING ASSEMBLY

(75) Inventors: Roy William Allsopp, Stramshall, Nr. Uttoxeter; David John Brown, Uttoxeter, both of (GB)

(73) Assignee: J. C. Bamford Excavators Limited, Staffordshire (GB)

( * ) Notice: Subject to any disclaimer, the term of this patent is extended or adjusted under 35 U.S.C. 154(b) by 0 days.

(21) Appl. No.: 09/598,592

(22) Filed: Jun. 21, 2000

(30) Foreign Application Priority Data

Jul. 2, 1999 (GB) ..... 9915402

(51) Int. Cl.[7] ..... E02F 3/96
(52) U.S. Cl. ..... 37/405; 414/724
(58) Field of Search ..... 37/403, 405, 410, 37/406; 414/724, 723, 912

(56) References Cited

U.S. PATENT DOCUMENTS

| | | | | |
|---|---|---|---|---|
| 2,705,082 | A | * | 3/1955 | Heimsoth |
| 2,816,676 | A | * | 12/1957 | Avery et al. |
| 3,975,844 | A | * | 8/1976 | Olson |
| 4,100,688 | A | | 7/1978 | Grist |
| 4,405,282 | A | * | 9/1983 | Carter |
| 4,669,947 | A | | 6/1987 | Frost |
| 4,692,089 | A | * | 9/1987 | Rodgers et al. |
| 5,544,435 | A | * | 8/1996 | Somero |
| 5,564,885 | A | * | 10/1996 | Staben, Jr. |
| 5,639,205 | A | | 6/1997 | Kaczmarczyk et al. |
| 6,098,320 | A | * | 8/2000 | Wass |
| 6,168,369 | B1 | * | 1/2001 | Bright et al. |

FOREIGN PATENT DOCUMENTS

| | | | |
|---|---|---|---|
| GB | 1034672 | | 6/1966 |
| GB | 1214368 | | 12/1970 |
| GB | 1 462 694 | | 1/1977 |
| GB | 2 160 495 | A | 12/1985 |
| SU | 771254 | * | 10/1980 |
| SU | 1684429 | * | 10/1991 |
| WO | WO 95/12038 | | 5/1995 |

* cited by examiner

*Primary Examiner*—Victor Batson
(74) *Attorney, Agent, or Firm*—Marshall, Gerstein & Borun

(57) ABSTRACT

A mounting assembly includes an arm, and a working implement mounting device provided at or towards one end of the arm, the working implement mounting device being adapted releasably to mount on the arm a first working implement, and the invention being characterised in that the working implement mounting device has mounted thereon, a second working implement, the second working implement being mounted such that the second working implement is movable relative to the working implement mounting device between a first position in which the second working implement may be used when the first working implement is de-mounted from the arm, and a second position in which the second working implement is stowed to allow use of the first working implement when mounted on the arm.

22 Claims, 5 Drawing Sheets

MOUNTING ASSEMBLY

BACKGROUND TO THE INVENTION

This invention relates to a mounting assembly and more particularly but not exclusively to a mounting assembly for mounting a working implement such as a loading bucket at one end of a loading arm.

DESCRIPTION OF THE PRIOR ART

Working machines are known which have one or more arms at the ends of which are mounted working implements such as loading implements. For example, typically a loading implement is a loading bucket or a pair of loading forks.

It is desirable to provide a mounting for such working implements which permits the working implement readily to be exchanged, to suit different tasks. Hence mountings commonly known as "quick hitches" have been developed which enable for example, a range of different sized loading buckets to be mounted on a working arm.

It has been found undesirable to provide a working implement consisting solely of loading forks, which can be mounted directly on the arm when desired. This is because such loading forks are prone to theft and loss on building and the like sites.

Hence it has been proposed to mount loading forks on a loading bucket. Such forks are generally movable from an, in use, position in which the forks extend forwardly of the bucket, to a stowed position in which the forks are pivoted to a position above and/or behind the bucket for stowage.

Such an arrangement solves the problems of loss and/or theft of the loading forks, but the designs hithertofore proposed have presented their own disadvantages.

For example, when the forks are in use, being located in front of the bucket, visibility for a machine operator is obscured making accurate positioning of the forks for optimum lifting efficiency and safety, unreliable.

Second, because the forks extend forwardly of the bucket, the overall radius of the machine during turning is increased which can present difficulty where space is restricted. Also, the load to be lifted is positioned further from a point of connection of the arm to the remainder of the machine making lifting performance inferior and possibly reducing the specification of the machine.

Third, because the forks are used in conjunction with what may be a dirty bucket, the forks themselves may become contaminated making subsequent stowing of the forks an unpopular task.

Fourth, current designs of fork mountings on the loading bucket are such that the forks are heavy to lift to and from the stowed position, and when in their stowed position, can rattle, particularly but not exclusively when the loading bucket is in use.

Fifthly, the presence of the forks mounted on the loading bucket can restrict manipulation of the bucket and are prone to fouling of structures adjacent the working machine.

SUMMARY OF THE INVENTION

According to a first aspect of the invention we provide a mounting assembly including an arm, and a working implement mounting device provided at or towards one end of the arm, the working implement mounting device being adapted releasably to mount on the arm a first working implement, and the invention being characterised in that the working implement mounting device has mounted thereon, a second working implement, the second working implement being mounted such that the second working implement is movable relative to the working implement mounting device between a first position in which the second working implement may be used when the first working implement is de-mounted from the arm, and a second position in which the second working implement is stowed to allow use of the first working implement when mounted on the arm.

Because the second working implement e.g. loading forks, is mounted on the working implement mounting device, the risk of loss/theft of the second loading implement is minimised and thus the assembly enjoys the advantages of prior arrangements where the loading forks are mounted on a first working implement e.g. bucket. However the disadvantages associated with such prior arrangements are substantially overcome in that with the first working implement e.g. bucket, de-mounted from the arm, an operator's vision during usage of the second working implement is not obscured, the turning radius of the machine is not increased or at least is not substantially increased, and because the load can be positioned closer to the machine, more stable lifting can be achieved, and with the absence of the e.g. bucket during use of the e.g. forks, the forks are less prone to contamination.

Also, positioning of the first working implement relative to the arm need not be compromised by the permanent presence of the second working implement on the working implement mounting device, giving more scope for designs which will not require such great effort to move the second working implement between the first and second positions as with known arrangements.

Preferably the working implement mounting device is attached to the arm by an attachment means which permits the working implement mounting device to be manipulated relative to the arm so that the working implement mounting device and working implement can be manipulated relative to the arm as one. Thus the working implement mounting device may have first mounting means for releasably mounting the first working implement, the first mounting means including an movable locking element which is movable between a locked position in which the locking element co-operates with a formation of the first working implement to mount the first working implement, and an unlocked position in which the first working implement may be de-mounted.

The working implement mounting device may have second mounting means for the second working implement, e.g. the second working implement may be pivotally mounted on the working implement mounting device for movement between the first and second positions.

The second working implement may be adapted for lifting an article, and when in the first position, a first part of the implement may engage with a support member of the working implement mounting device to prevent further downward pivoting of the second working implement during lifting. Conversely, when the second working implement is pivoted to the second, stowed, position, a second part of the implement may engage with a stop member either provided on the working implement mounting device or the first working implement, to prevent further pivoting beyond the second position.

To prevent the second working implement unintentionally moving from the stowed position, restraining means on the working implement mounting device or the first working implement may be provided to restrain the second working implement from pivoting from the second position when stowed.

In one embodiment the working implement mounting device includes a cylindrical mounting member and the second working implement includes a pair of loading members pivotally mounted on the cylindrical mounting member, and the loading members of the pair being relatively movable along the cylindrical member bar.

Each of the loading members of the pair may have first and second mutually generally perpendicular portion, the first portion being adapted to cooperate with an article to be loaded, and the second portion including a mounting portion by means of which the loading member is pivotally mounted on the working implement mounting device.

In one arrangement the second portion of each of the pair of loading members, is movable relative to the mounting portion such that when the second working implement is moved to the second position, at least a part of the first portion is located generally behind the working implement mounting device. Thus stowage of the forks is more elegant.

The second portion of each of the pair of loading members, may be pivotal relative to the mounting portion or otherwise movable.

In each case preferably the second portions of the loading members and the corresponding mounting portions have co-operating means which cooperate so that in use, at least when the loading members are loaded, relative movement between the second and mounting portions of the loading members is resisted.

According to a second aspect of the invention we provide a working implement mounting device for use in an assembly according to the first aspect of the invention, the device being adapted to have mounted thereon a second working implement.

According to a third aspect of the invention we provide a working machine having a mounting assembly according to the first aspect of the invention.

BRIEF DESCRIPTION OF THE DRAWINGS

The invention will now be described with reference to the accompanying drawings in which.

DESCRIPTION OF THE PREFERRED EMBODIMENTS

Figure 1:
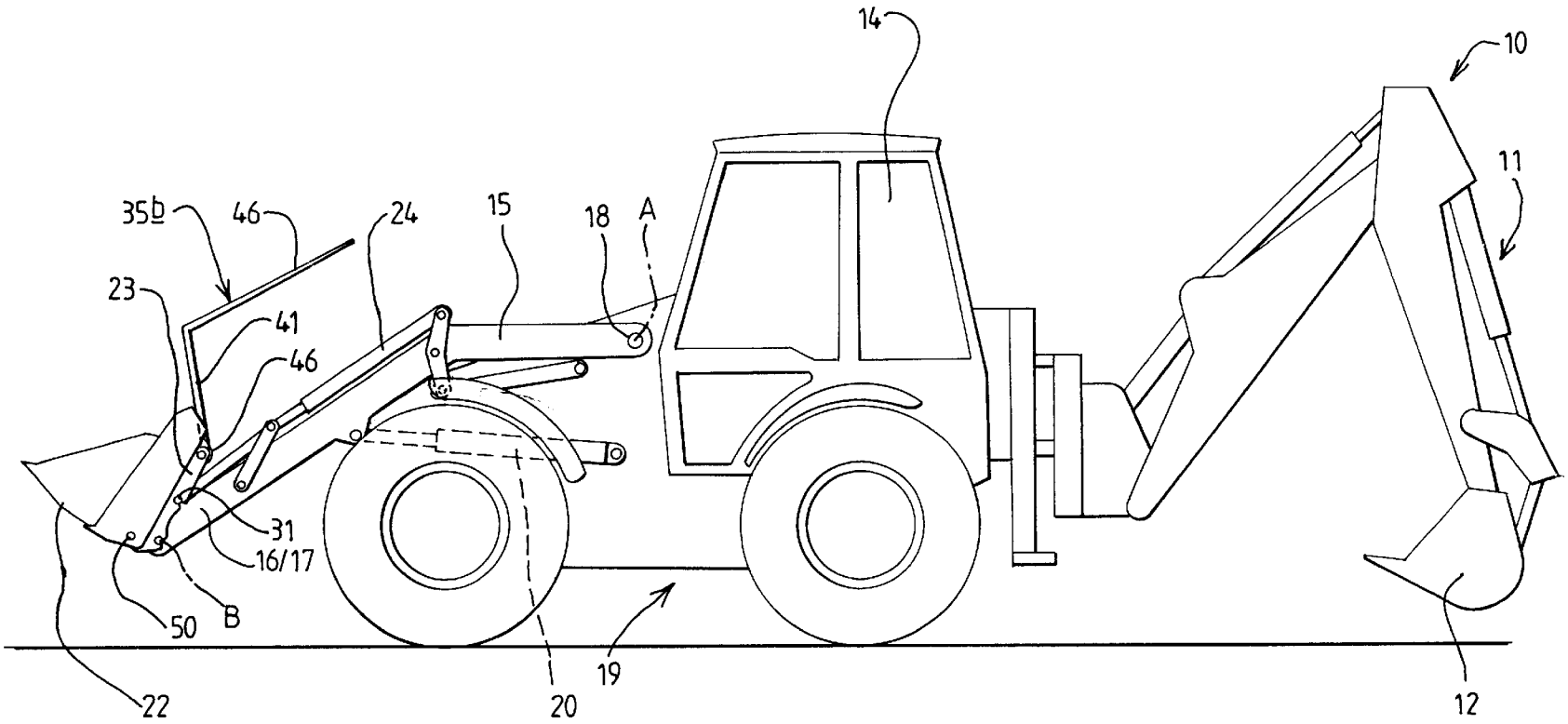
FIG. 1 is an illustrative side view of a working machine having a mounting assembly in accordance with the invention.

Referring to the FIGS. 1 to 4 of the drawings there is shown a working machine being in this example a combined loading and excavating machine 10. The machine has an excavating arm 11 at a rear end of the machine 10, which includes an excavating bucket 12, the excavating arm 11 and excavating bucket 12 being manipulated by power operated means operated from within an operator's cab 14 of the machine.

For loading, the machine 10 has a further working arm 15, at a front end of the machine 10.

The present invention will be described particularly with reference to the working or loading arm 15 although it will be appreciated that the invention may be applied to any other working aim which mounts a working implement, such as for example only an excavating arm such as arm 11.

The loading arm 15 includes a pair of arm members 16, 17 which are pivoted at their one ends 18 to a body 19 of the machine 10, and the arm 15 may be raised and lowered with respect to the body 19 about a first generally horizontal axis A by power operated means such as one or more hydraulic actuators 20, under the control of the operator within cab 14.

At or towards an outer end of the loading arm 15 opposite from the first generally horizontal axis A, the loading arm 15 mounts a first working implement comprising a loading bucket 22, via a working implement mounting device 23. The bucket 22 and mounting device 23 are generally rigidly connected and are thus in use, relatively immovable in this example. The loading bucket 22 may be manipulated relative to the arm 15 by means of a pair of hydraulic actuators 24 on the arm 15 and which act between the arm 15 and the mounting device 23, for pivotal movement about a second generally horizontal axis B. The bucket 22 may be used for loading material such as soil, sand, or other materials.

The mounting device 23 includes a pair of side members 26, 27 fixed relative to each other and to a main transverse structural members 39. Each side member 26, 27 has a pair of generally parallel plate like parts 26*a*, 26*b* or 27*a*, 27*b*. Each of the plates 26*a*, 26*b*, 27*a*, 27*b*, have aligned openings 28 through which a connecting pin 29 may be passed, with the arm member 16 of the arm 15 received between one of the pairs of the plates 26*a*, 26*b* and the other arm member 17 received between the other of the pairs of the plates 27*a*, 27*b*. The arm members 16, 17 each have openings through which the connecting pin 29 passes to attach the mounting device 23 to the arm 15. Links 30 connect the implement actuators 24 to the mounting device 23, by means of a further connecting pin 31 passing through openings in the links 30 and through corresponding openings 32 in the plates 26*a*, 26*b*, 27*a*, 27*b*, with the links 30 being received between a respective pair of the plates.

Thus the mounting device 23 may be pivoted at the end of the arm 15 by operating the actuators 24.

The mounting device 23 is of the so called "quick hitch" type whereby the bucket 22 may readily be mounted and de-mounted therefrom. To that end, the bucket 22 has a hook like formation 46 at either side thereof towards an upper end of the bucket 22, the hook like formations 46 being adapted to hook on to a mounting member being a cylindrical mounting bar 47 which extends between the outer plates 26*a*, 27*b* of the side members 26, 27 of the mounting device 22. Thus the bucket 22 may readily be hooked onto the bar 47. To lock the bucket 22 relative to the mounting device 23, the bucket 22 has towards a lower end thereof a pin receiving passage 48, and the side members 26, 27 of the mounting device 23 have openings 49 which may be aligned with the passage 48 to enable locking element being a mounting pin 50, to be inserted.

The mounting device 23 mounts thereon a second working implement which in this example includes a pair of loading members or forks 35*a*, 35*b*. The loading members 35*a*, 35*b* each include a first and second generally mutually perpendicular portions 40, 41, and a mounting portion 42 connected to the second portion 41 and extending transversely relative thereto. The first portions 40 are adapted to receive a load thereon. The mounting portion 42 has a passage which receives therein, the mounting bar 47 of the mounting device 23.

Figure 3:
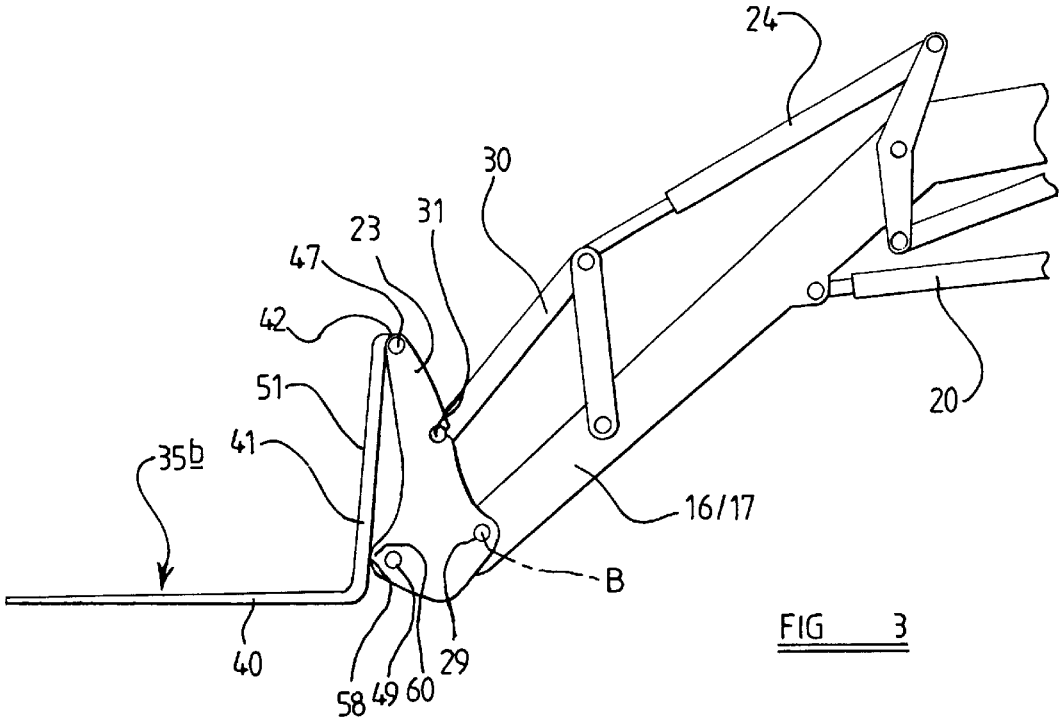
FIG. 3 is a view similar to FIG. 2 but with the first working implement de-mounted and a second working implement in an operative position.
Figure 4:
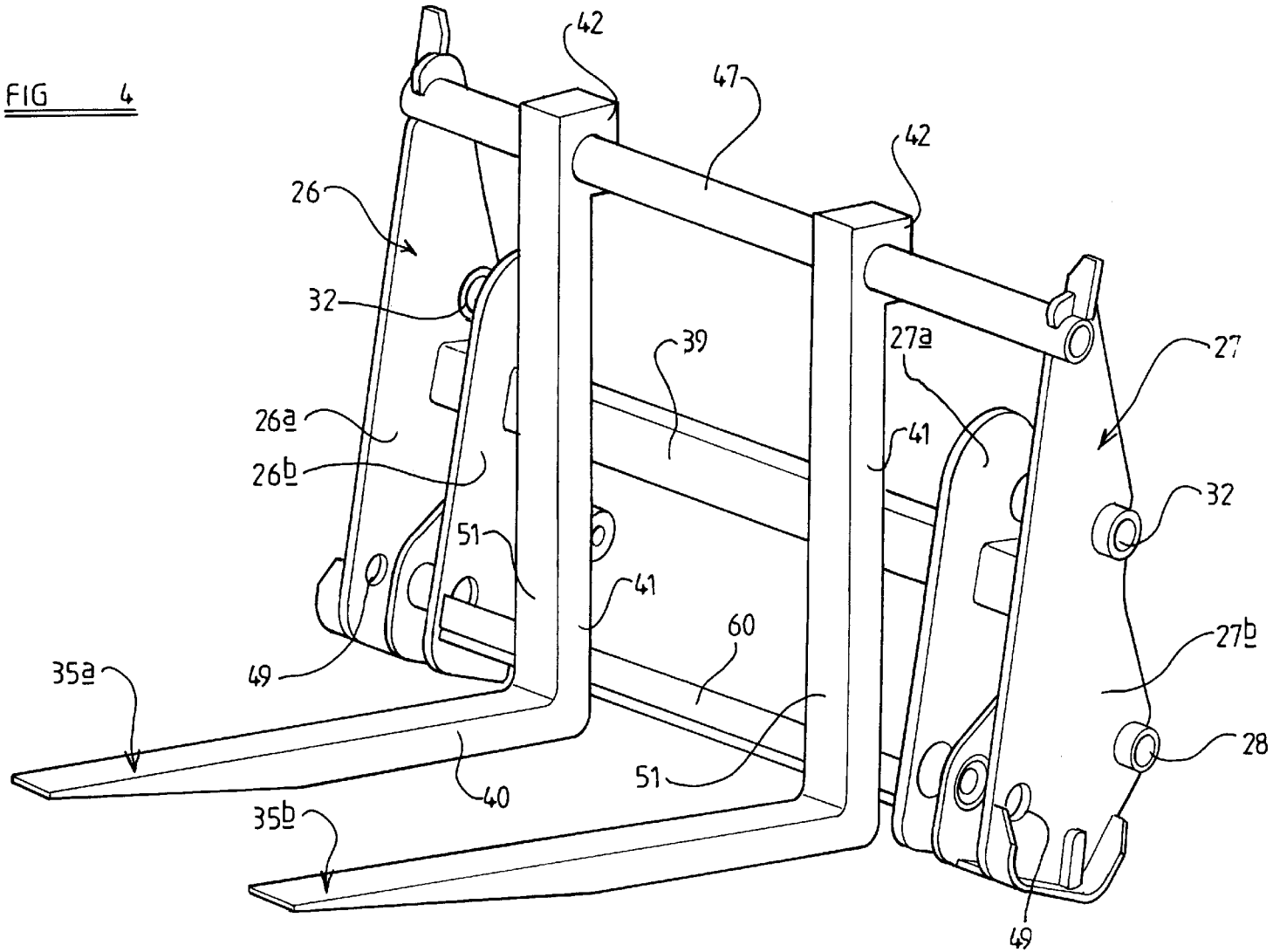
FIG. 4 is an illustrative perspective view of the assembly of FIG. 3, but not showing the working arm.

The loading members 35*a*, 35*b* may be moved towards or away from one another along the bar 47, at least when in the operative position shown in FIGS. 3 and 4, to accommodate different widths of articles to be lifted.

It will be appreciated that the loading members 35*a*, 35*b* may only be in the position shown in FIGS. 3 and 4 if the loading bucket 22 is first de-mounted from the mounting device 23.

Figure 2:
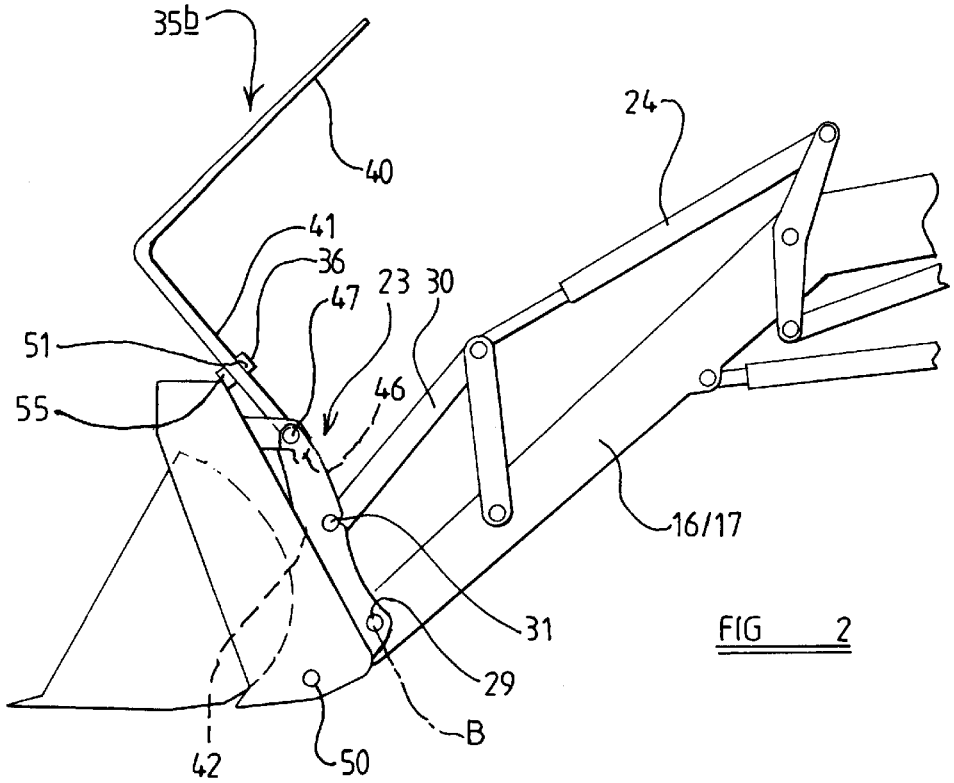
FIG. 2 is an enlarged illustrative side view of the mounting assembly of the machine of FIG. 1 with a first working implement mounted on a working arm thereof.

When the bucket 22 is mounted on the arm 15, the loading members 35*a*, 35*b* are stowed. This is achieved by pivoting the members 35*a*, 35*b* upwardly until a part of the second portion 41 of the second working implement, i.e. part 51 of the third portion 42, engages with a stop member 36 of the loading bucket 22, on the mounting bar 47, in which position, the first portions 40 of the loading members 35*a*, 35*b* will extend generally upwards as seen in FIGS. 1 and 2, at least when the mounting device 23 and bucket 22, are in the orientations shown . The loading members 35*a*, 35*b* may be restrained in this stowed position by any suitable restraining means. In the present example the loading arms 35*a*, 35*b* will co-operate with brackets provided on an upper external surface part 55 of the bucket 22 to restrain the loading members 35*a*, 35*b* from unintentionally pivoting e.g. under gravity, back to their operative positions.

When the bucket 22 is de-mounted from the mounting means 23 by removing the mounting pin 50 and unhooking the hook formations 46 from the mounting bar 47. The loading members 35*a*, 35*b* may be moved to their operative positions in which a rear surface part 58 of each member will engage with a support member 60 which extends between the side members 26, 27 of the mounting device 23, to restrain further pivoting movement of the loading members 35*a*, 35*b* beyond the operative position shown in which the first portions 40 of the loading members 35*a*, 35*b* extend generally forwards to receive thereon an article to be lifted and loaded.

By virtue of the loading members 35*a*, 35*b* being mounted on the mounting device 23 as shown, on the bar 47, when the bucket 22 is removed handling of the loading members 35*a*, 35*b* between the stowed and operative positions is facilitated. Also, as the loading members 35*a*, 35*b* mounted on the mounting device and are stowed in engagement with brackets of the bucket 22, the loading members 35*a*, 35*b* are less prone to rattle as the bucket 22 is used than in known arrangements, in which the loading members 35*a*, 35*b* are mounted on the bucket, and the loading members 35*a*, 35*b* are less prone to interfere with the normal operation of the bucket 22 thereby not preventing the bucket 22 from being manipulated through its full range of movement.

Various modifications may be made without departing from the scope of the invention.

For example, loading members 35*a*, 35*b* as described are only examples of working implements it may be desired to stow on the mounting device 23 of the machine 10 rather than removing them when not required for use.

The geometries of the arm 15, and mounting device 23 described are only given by way of examples.

The first working implement 22 although typically is a loading bucket, may in another example be a hammer attachment or any other kind of working implement.

The machine 10 need not be a combined excavating and loading machine 10 but may be a loading or excavating machine only.

Figure 5A:
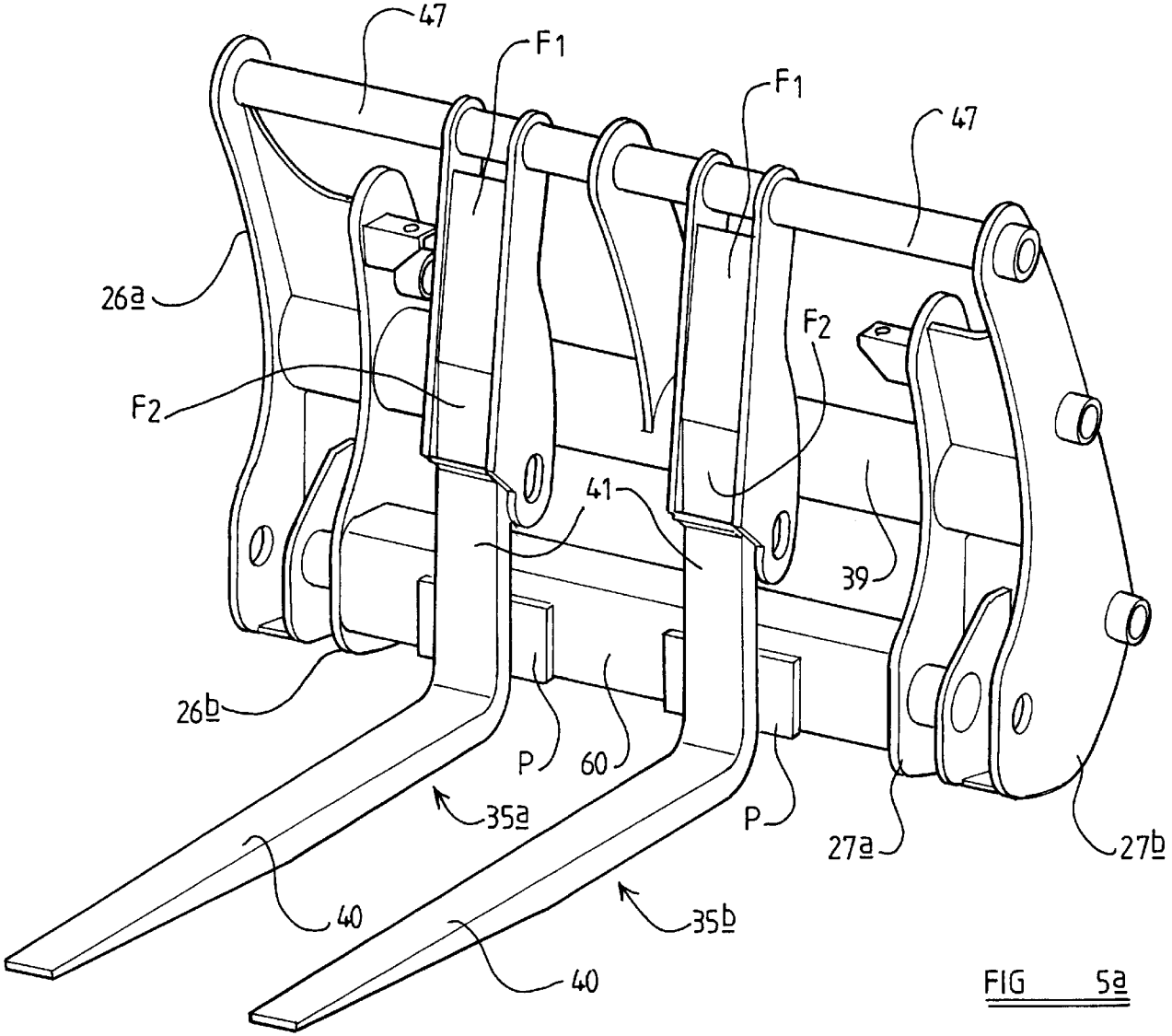
FIGS. 5*a* and 5*b* are illustrative perspective views of a modified second working implement mounted on an implement mounting device, shown in stowed and in use positions respectively.
Figure 5B:
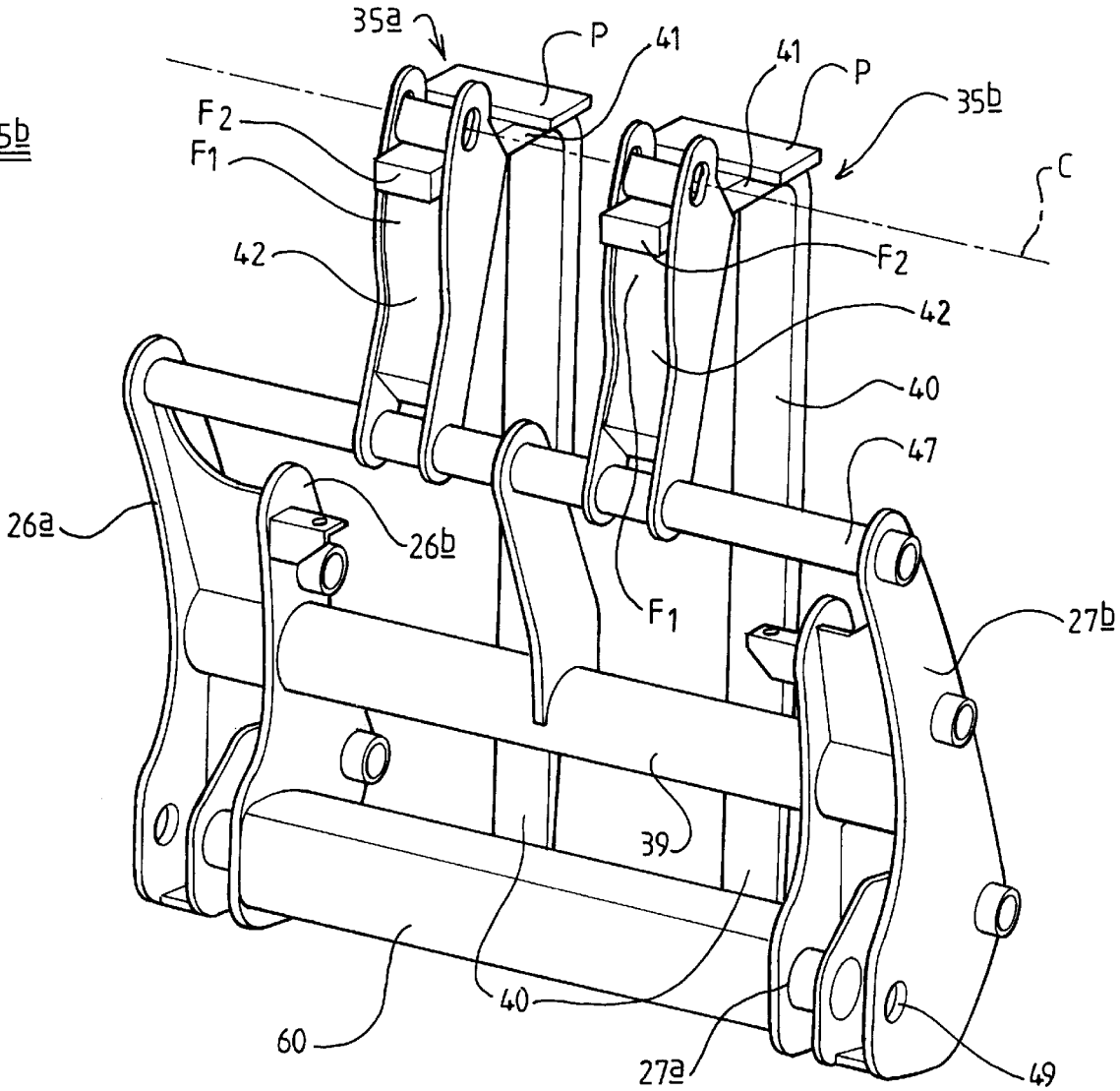

Referring now to FIGS. 5*a* and 5*b*, there is shown a modified arrangement. Parts similar to those described above with reference to FIGS. 1 to 4 are indicated with the same reference numerals.

In this arrangement, the first and second mutually perpendicular portions 40, 41 of the loading members 35*a*, 35*b* are pivotal relative to the mounting portion 42 about an axis indicated at C, so that when the loading members 35*a*, 35*b* are pivoted to the second stowed position, the first and second portions 40, 41 may be folded relative to the mounting portion, so that the first portions 40 extend downwardly such that the free ends thereof may be accommodated generally behind the mounting device 23, and thus behind the bucket 22 when re-mounted.

This provides for more elegant stowage of the loading members 35*a*, 35*b* than in the previously described embodiment.

When the loading members 40, 41 are in the second stowed position shown in FIG. 5*b*, there may be provided some means to engage with the first portions 40 to retain the first portions relative to the mounting device 23.

When the loading members 35*a*, 35*b* are in the first, is use, position of FIG. 5*a*, pads P provided adjacent the points of connection between the first and second portions 40, 41 of the loading members 35*a*, 35*b* may bear on the support member 60 of the mounting device 23, and co-operating formations F1, F2 of the second portions 41 and the mounting portions 42 may co-operate as shown to prevent relative pivotal movement between the mounting portions 42 and the second portions 41 of the loading members 35*a*, 35*b* beyond an in-line position, so that the loading members 35*a*, 35*b* may be used for lifting loads.

It will be appreciated that as the loading members 35*a*, 35*b* are loaded, the co-operating formations will be urged into grater co-operation to resist relative pivoting between the mounting portions 42 and the second portions 41 of the loading members 35*a*, 35*b*.

If desired, the mounting portions 42 and second portions 41 of the loading members 35*a*, 35*b* may be relatively movable other than by pivoting, for more elegant stowage of the loading members when the bucket 22 is to be used.

What is claimed is:

1. A mounting assembly including an arm, and a working implement mounting device provided at or towards one end of the arm, the working implement mounting device being adapted releasably to mount on the arm a first working implement, and the working implement mounting device having mounted thereon, a second working implement, the first and second working implements being independently usable, the mounting of the second working implement on the working implement mounting device enabling the second working implement to be moved relative to the working implement mounting device between a first position when the first working implement is de-mounted from the arm, and a second position, the second working implement when in the first position being usable independent of the de-mounted first working implement, and when in the second position being stowed to allow use of the first working implement, when mounted on the arm, independent of the stowed second working implement.

2. An assembly according to claim 1 wherein the working implement mounting device is attached to the arm by an attachment means which permits the working implement mounting device to be manipulated relative to the arm.

3. An assembly according to claim 1 wherein the working implement mounting device has first mounting means for releasably mounting the first working implement, the first mounting means including a movable locking element which is movable between a locked position in which the locking element co-operates with a formation of the first working implement to mount the first working implement, and an unlocked position in which the first working implement may be de-mounted.

4. An assembly according to claim 1 wherein the second working implement is pivotally mounted on the working implement mounting device for movement between the first and second positions.

5. An assembly to claim 4 wherein the second working implement is adapted for lifting an article, and when in the first position, a first part of the second working implement enages with a support member of the working implement mounting device to prevent further down ward pivoting of the second working implement during lifting.

6. An assembly according to claim 4 wherein when the second working implement is pivoted to the second, stowed, position, a second part of the implement engages with a stop either provided on the working implement mounting device or the first working implement to prevent further pivoting beyond the second position.

7. An assembly according to claim 6 wherein restraining means are provided to restrain the second working implement from pivoting from the second position when stowed.

8. An assembly according to claim 4 wherein the working implement mounting device includes a cylindrical mounting member and the second working implement includes a pair of loading members pivotally mounted on the cylindrical mounting member, and the loading members of the pair being relatively movable along the cylindrical member.

9. An assembly according to claim 8 wherein the cylindrical mounting member is a mounting bar on which the first working implement is mounted in use.

10. An assembly according to claim 8 wherein each of the loading members of the pair has first and second mutually generally perpendicular portions, the first portion being adapted to co-operate with an article to be loaded, and the second portion including a mounting portion by means of which each of the loading members is pivotally mounted on the working implement mounting device.

11. An assembly according to claim 10 wherein the second portion of each of the pair of loading members, is movable relative to the mounting portion such that when the second working implement is moved to the second position, at least a part of the first portion is located generally behind the working implement mounting device.

12. An assembly according to claim 11 wherein the second portion of each of the pair of loading members, is pivotal relative to the mounting portion.

13. An assembly according to claim 11 wherein the second portions of the loading members and the corresponding mounting portions have co-operating means which co-operate so that in use, at least when the loading members are loaded, relative movement between the second and first portions of the loading members is resisted.

14. A working implement mounting device for use in an assembly according to claim 1, the device being adapted to have mounted thereon a second working implement.

15. A working machine having a mounting assembly according to claim 1.

16. A mounting assembly including an arm, and a working implement mounting device provided at or towards one end of the arm, the working implement mounting device being adapted releasably to mount on the arm a first working implement, and the working implement mounting device having mounted thereon, a second working implement, the second working implement being mounted such that the second working implement is movable relative to the working implement mounting device between a first position in which the second working implement may be used when the first working implement is de-mounted from the arm, and a second position in which the second working implement is stowed to allow use of the first working implement when mounted on the arm, and the working implement mounting device including first mounting means for releasably mounting the first working implement, the first mounting means including a movable locking element which is movable between a locked position in which the locking element co-operates with a formation of the first working implement to mount the first working implement, and an unlocked position in which the first working implement may be de-mounted.

17. An assembly according to claim 16, wherein the second working implement is pivotally mounted on the working implement mounting device for movement between the first and second positions.

18. An assembly according to claim 17, wherein the second working implement is adapted for lifting an article, and when in the first position, a first part of the second working implement engages with a support member of the working implement mounting device to prevent further downward pivoting of the second working implement during lifting.

19. An assembly according to claim 17, wherein when the second working implement is pivoted to the second, stowed, position, a second part of the implement engages with a stop either provided on the working implement mounting device or the first working implement to prevent further pivoting beyond the second position.

20. An assembly according to claim 19, wherein restraining means are provided to restrain the second working implement from pivoting from the second position when stowed.

21. An assembly according to claim 17, wherein the working implement mounting device includes a cylindrical mounting member and the second working implement includes a pair of loading members pivotally mounted on the cylindrical mounting member, and the loading members of the pair being relatively movable along the cylindrical member.

22. An assembly according to claim 21, wherein the cylindrical mounting member is a mounting bar on which the first working implement is mounted in use.

* * * * *

UNITED STATES PATENT AND TRADEMARK OFFICE

CERTIFICATE OF CORRECTION

PATENT NO. : 6,408,550 B1 
DATED : June 25, 2002
INVENTOR(S) : Roy William Allsopp et al.

It is certified that error appears in the above-identified patent and that said Letters Patent is hereby corrected as shown below:

Column 7,
Line 12, "to claim" should be -- according to claim --.
Line 16, "down ward" should be -- downward --.

Signed and Sealed this

Twenty-eighth Day of January, 2003

JAMES E. ROGAN
*Director of the United States Patent and Trademark Office*